US007997047B1

(12) United States Patent
Sargent

(10) Patent No.: US 7,997,047 B1
(45) Date of Patent: Aug. 16, 2011

(54) AIR EVACUATION ASSEMBLY FOR SEALABLE PLASTIC BAGS

(75) Inventor: Ronald J. Sargent, Fort Lauderdale, FL (US)

(73) Assignee: Widgeteer, Inc., Oakwood Hills, IL (US)

( * ) Notice: Subject to any disclaimer, the term of this patent is extended or adjusted under 35 U.S.C. 154(b) by 0 days.

(21) Appl. No.: 12/542,858

(22) Filed: Aug. 18, 2009

Related U.S. Application Data

(63) Continuation-in-part of application No. 12/074,529, filed on Mar. 4, 2008, now abandoned.

(51) Int. Cl.
*B65B 31/04* (2006.01)
*B65B 31/08* (2006.01)

(52) U.S. Cl. ..... 53/79; 53/512; 383/59; 383/103

(58) Field of Classification Search ..... 53/510, 53/512, 403, 405, 408, 79; 206/524.8; 251/149.6, 251/149.1; 383/59, 66, 100, 103; 137/533.11; 215/312; 141/65; *B65B 31/04, 31/08*
See application file for complete search history.

(56) References Cited

U.S. PATENT DOCUMENTS

| | | | | | |
|---|---|---|---|---|---|
| 2,677,388 | A | * | 5/1954 | Neff | 383/3 |
| 2,855,127 | A | * | 10/1958 | Lerner et al. | 137/533.11 |
| 3,742,994 | A | * | 7/1973 | Pensak | 383/3 |
| 3,779,429 | A | * | 12/1973 | Porcelli | 222/500 |
| 3,943,987 | A | * | 3/1976 | Rossi | 206/524.8 |
| 4,142,645 | A | * | 3/1979 | Walton | 137/533.11 |
| 4,214,675 | A | * | 7/1980 | Schmit | 222/83 |
| 4,337,804 | A | | 7/1982 | Maruscak | |
| 4,754,595 | A | | 7/1988 | Sanderson | |
| 5,215,445 | A | | 6/1993 | Chen | |
| 5,228,271 | A | * | 7/1993 | Wallace | 53/512 |
| 5,287,680 | A | | 2/1994 | Lau | |
| 5,332,095 | A | | 7/1994 | Wu | |
| 5,338,166 | A | * | 8/1994 | Schultz | 53/512 |
| 5,450,963 | A | * | 9/1995 | Carson | 206/524.8 |
| 5,711,136 | A | | 1/1998 | Carcano | |
| 5,818,059 | A | | 10/1998 | Coyne et al. | |
| 5,873,217 | A | | 2/1999 | Smith | |
| 5,931,189 | A | * | 8/1999 | Sweeney et al. | 383/103 |
| 5,996,800 | A | | 12/1999 | Pratt | |
| 6,070,397 | A | | 6/2000 | Bachhuber | |
| D513,924 | S | | 1/2006 | Benedict | |
| 7,140,402 | B2 | | 11/2006 | Russell | |

(Continued)

FOREIGN PATENT DOCUMENTS

DE 3500803 A1 * 7/1986

(Continued)

*Primary Examiner* — Stephen F Gerrity
(74) *Attorney, Agent, or Firm* — Brannen Law Office, LLC

(57) ABSTRACT

The present invention relates generally to an air evacuation assembly and methods of using the same, and in particular to an assembly used to evacuate air from a sealable plastic bag and to form an air tight seal, and to the methods of using the same. In a preferred embodiment, a valve assembly is provided with an inside piece that is matable with an outside piece. A plastic bag is pierced, and a gasket forms a seal with the bag when the inside piece and outside piece are threadably engaged. A check ball is contained within a spout. The ball can seal the inside of the bag, or alternatively be moved to allow air to evacuate from the bag. An external rib is provided for forming a tight engagement between the valve assembly and a pump and/or a cap.

8 Claims, 10 Drawing Sheets

U.S. PATENT DOCUMENTS

| | | | | |
|---|---|---|---|---|
| 7,197,860 | B2 | 4/2007 | Hughes et al. | |
| 7,513,481 | B2 | 4/2009 | Su | |
| 2005/0161092 | A1* | 7/2005 | Greene et al. | 137/533.11 |
| 2005/0172577 | A1 | 8/2005 | Oltrogge | |
| 2007/0154118 | A1 | 7/2007 | Tilman et al. | |
| 2009/0026401 | A1 | 1/2009 | Dobkins | |
| 2009/0206295 | A1* | 8/2009 | Morgan | 383/103 |

FOREIGN PATENT DOCUMENTS

| | | | |
|---|---|---|---|
| JP | 4-189752 | A | 7/1992 |
| JP | 4-242544 | A | 8/1992 |

* cited by examiner

AIR EVACUATION ASSEMBLY FOR SEALABLE PLASTIC BAGS

This application is a continuation in part application of United States patent application filed on Mar. 4, 2008 and having application Ser. No. 12/074,529, now abandoned, the entire contents of which are hereby incorporated herein by reference.

BACKGROUND OF THE INVENTION

1. Field of the Invention

The present invention relates generally to an air evacuation assembly and methods of using the same, and in particular to an assembly used to evacuate air from a conventional sealable plastic bag and to form an air tight seal, and to the methods of using the same.

2. Background of the Invention

Plastic bags are widely used to store a variety of items. In one environment, the kitchen, the bags are typically of the disposable or single use variety. Sealable bags are among the most common types. It is commonly understood that it is desirable to remove or evacuate as much of the internal air as possible in a storage situation, in order to preserve the freshness of the contents, and accordingly to increase the item's shelf life.

A number of patents have issued over the years purporting to evacuate air from a bag or container. Some examples include:

U.S. Pat. No. 7,240,402 to Russell is titled Vacuum Storage System and method, and teaches a vacuum storage system and method in which a lid closure is punctured. A vacuum pump is then taught to remove atmospheric gas from the container and the lid is sealed with a valve or thin film held in place with an adhesive.

U.S. Pat. No. 7,197,860 to Hughes, et al. is titled Method and Apparatus for Vacuum Sealing, and discloses a device configured to remove air from zipper-sealed bags and is in communication with a vacuum source.

U.S. Pat. No. 6,070,397 to Bachhuber is titled Self Sealing Storage System and Patch Thereof, and shows a self-sealing storage bag with an adhesive patch constructed as part of the bag.

U.S. Pat. No. 5,873,217 to Smith is titled Vacuum Sealing Methods and Apparatus, and shows an article comprising a hand-held vacuum source for evacuating a zipper-type bag.

U.S. Pat. No. 5,711,136 to Carcano is titled Device and Method for Creating a Vacuum in Bags, and discloses an inner tube that can slide axially inside an outer tube to insert into a bag.

U.S. Pat. No. 5,287,680 to Lau is titled Vacuum Packing Device, and discloses a battery-powered, hand-held device for evacuating air from and sealing a plastic bag.

U.S. Pat. No. 5,215,445 to Chen is titled Handy Vacuum Pump and heat Sealer Combination Device, and discloses a vacuum pump and heat sealer combination device for evacuating air from a thermoplastic bag and sealing food inside the bag. A small-scale heat sealer and vacuum pump are required, as are batteries.

U.S. Pat. No. 4,754,595 to Sanderson is titled Method of Sterilizing and Storing Articles, wherein one or more valves are shown to result in a vacuumized sterile package.

U.S. Pat. No. 4,337,804 to Maruscak is titled Household System for Vacuum Packing Foods, and teaches the use of a suction tube and a needle valve for penetrating the wall of a container are shown.

U.S. Pat. No. D513,924 shows an ornamental design of a hand-held vacuum apparatus. United States Published Patent Application Number US2007/0154118 to Tilman shows a polymeric package with resealable closure and valve and methods relating thereto.

United States Published Patent Application Number US2009/0026401 to Dobkins is titled Systems and Methods for Vacuum Sealing. This patent application shows a valve assembly for vacuum sealing a collapsible storage bag. Two valve parts, with a portion of the wall there between, causes the wall to break and/or puncture.

Japanese Patent Number JP 404189752A is titled Opening and Closing Device for Bag Evacuation Opening.

None of these references show a system wherein a check valve within the valve assembly operates to seal a pump cavity during operation evacuation of the air from a bag.

None of these references show both a valve assembly with a check valve and a pump with a check valve, wherein both check valves operate along the same longitudinal axis.

None of these references show an internal cavity with one or more retainers holding a check ball within the cavity, yet allowing air to escape around the check ball.

None of these references show a valve assembly having two twistably or rotatably engaging valve pieces.

None of these references show an internal gasket for creating a seal with bags of various thicknesses, and that allows valve pieces to be rotatably engaged without causing the bag to bunch or bind.

None of these references show a rib on the outside of an outer piece that selectably mates with a ridge in the end of a pump or a ridge within a cap.

Thus there exists a need for an air evacuation assembly and methods of using the same that solves these and other problems.

SUMMARY OF THE INVENTION

The present invention relates generally to an air evacuation assembly and methods of using the same, and in particular to an assembly used to evacuate air from a sealable plastic bag and to form an air tight seal, and to the methods of using the same. In a preferred embodiment, a valve assembly is provided with an inside piece that is matable with an outside piece. A plastic bag is pierced, and a gasket forms a seal with the bag when the inside piece and outside piece are threadably engaged. A check ball is contained within a spout. The ball can seal the inside of the bag, or alternatively be moved to allow air to evacuate from the bag. An external rib is provided for forming a tight engagement between the valve assembly and a pump and/or a cap.

According to one advantage, the present invention comprises a system wherein a check valve within the valve assembly operates to seal a pump cavity during operation evacuation of the air from a bag.

According to a further advantage, the present invention incorporates both a valve assembly with a check valve and a pump with a check valve, wherein both check valves operate in a collinear manner such that they move along the same longitudinal axis.

According to a still further advantage, the present invention has an internal cavity with one or more retainers holding a check ball within the cavity. Air is allowed to pass around the check ball and between the retainers.

According to a still further advantage yet, the present invention comprises a valve assembly having two twistably or rotatably engaging valve pieces. This advantageously allows for the valve assembly to be used with bags of varying thickness without compromising effectiveness.

According to a still further advantage yet, the present invention has an internal gasket for creating a seal on bags of various thicknesses, and that allows valve pieces to be rotatably engaged without causing the bag to bunch or bind.

According to a still further advantage yet, the present invention contains a rib on the outside of an outer piece that selectably mates with a ridge in the end of a pump or a ridge within a cap to ensure tight engagement between the respective components.

Other advantages, benefits, and features of the present invention will become apparent to those skilled in the art upon reading the detailed description of the invention and studying the drawings.

DETAILED DESCRIPTION OF THE PREFERRED EMBODIMENTS

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

Figure 4:
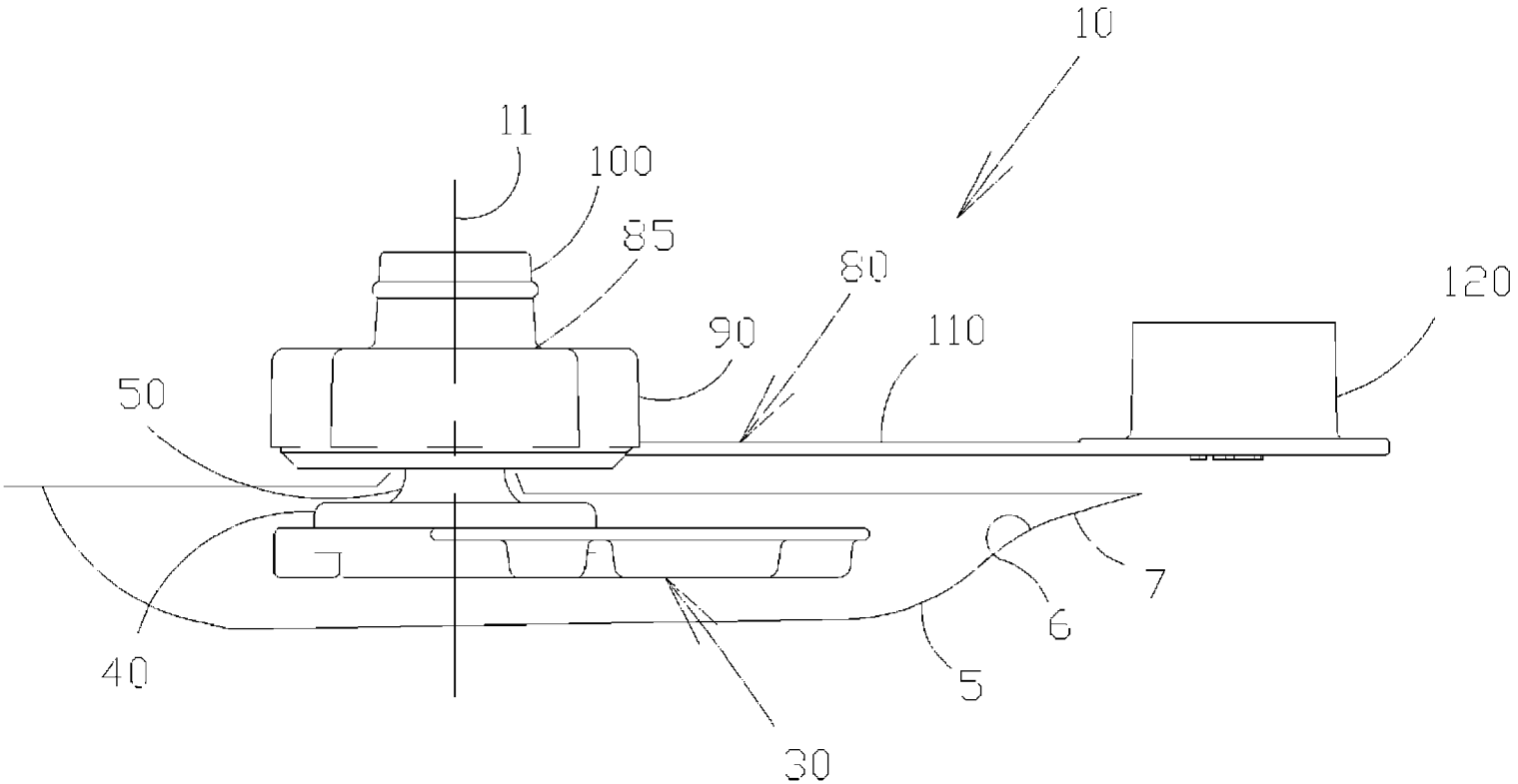
FIG. 4 is a side view of the inside piece within a bag and the outside piece outside of the bag and in partial engagement with the inside piece before a seal is formed.
Figure 6:
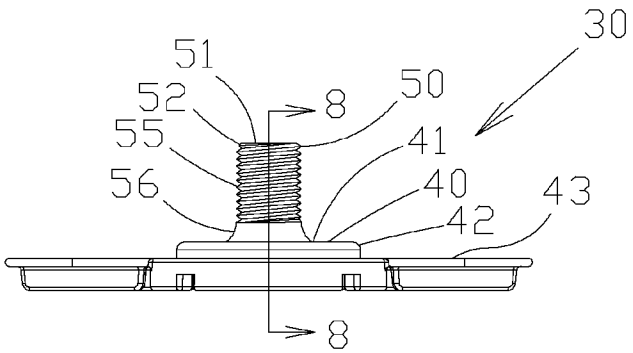
FIG. 6 is an end view of the embodiment shown in FIG. 5.
Figure 5:
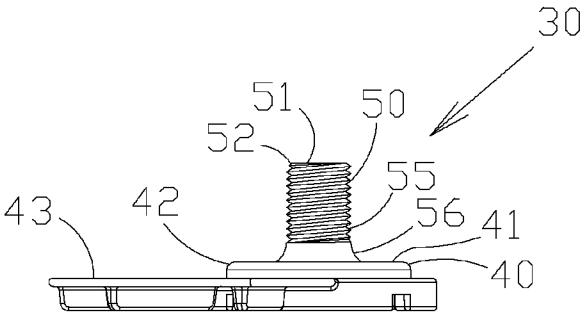
FIG. 5 is a side view of an embodiment of the inside piece of the present invention.
Figure 7:
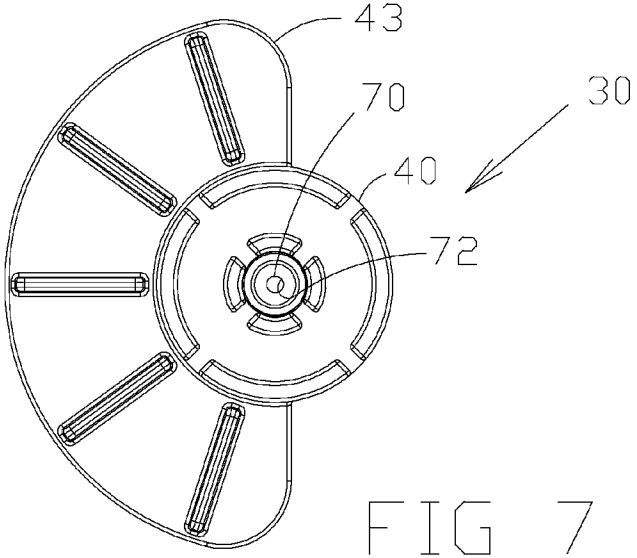
FIG. 7 is a bottom view of the embodiment shown in FIG. 6.
Figure 8:
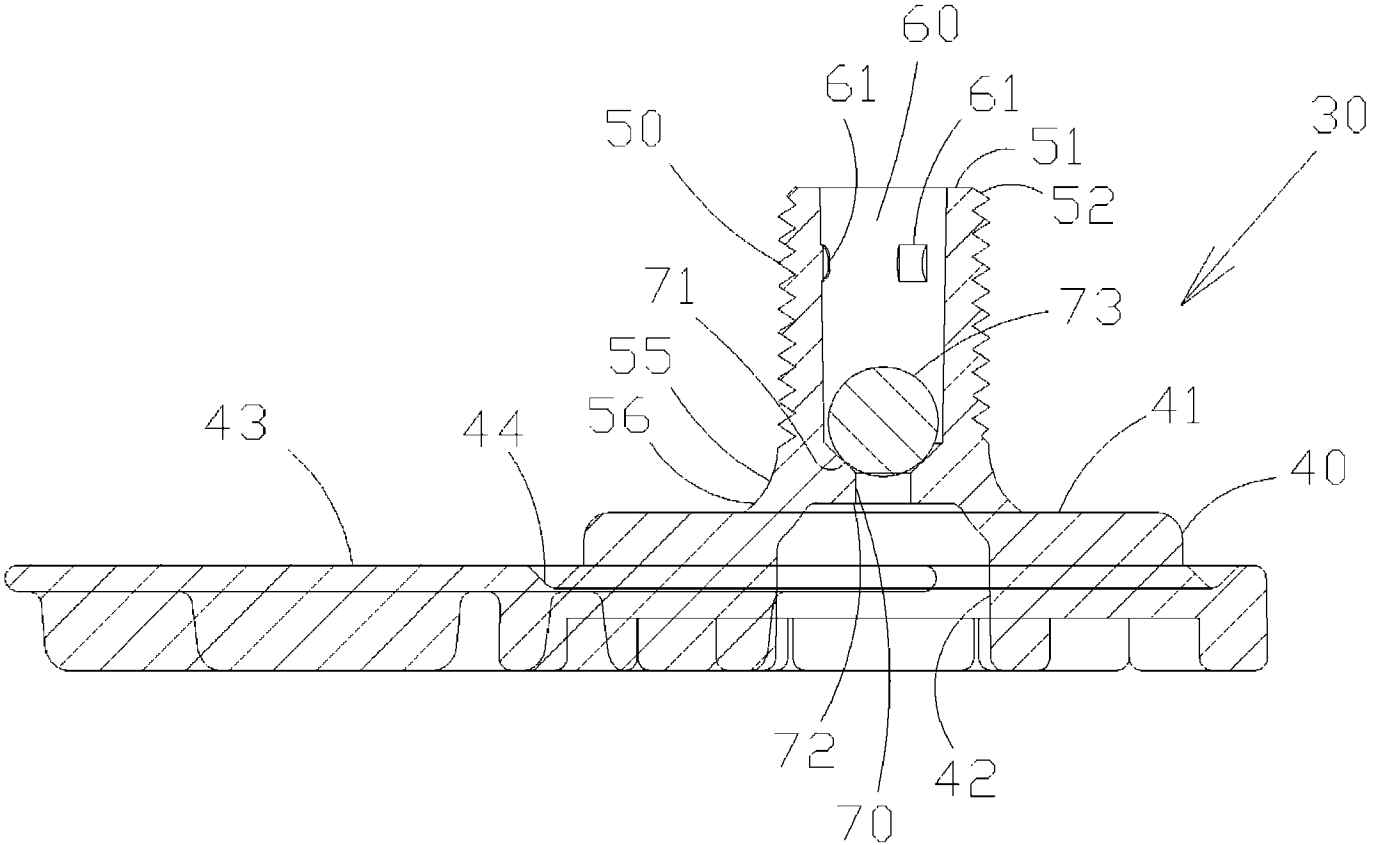
FIG. 8 is a cross-sectional view taken along line 8-8 in FIG. 6
Figure 9:
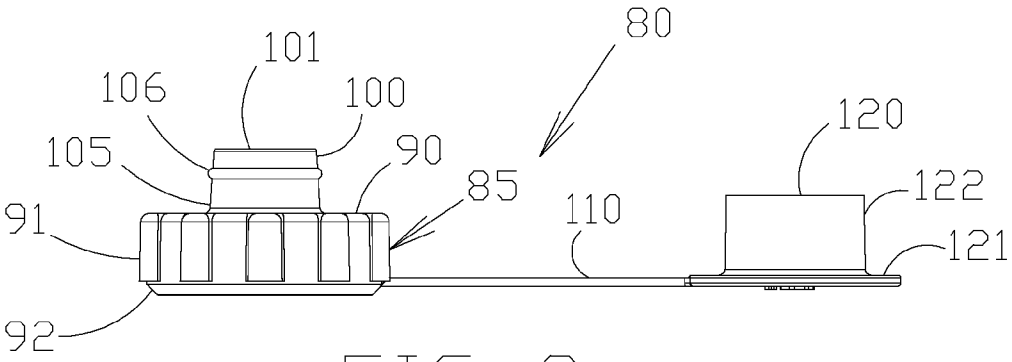
FIG. 9 is a side view of an embodiment of the outside piece of the present invention.
Figure 10:
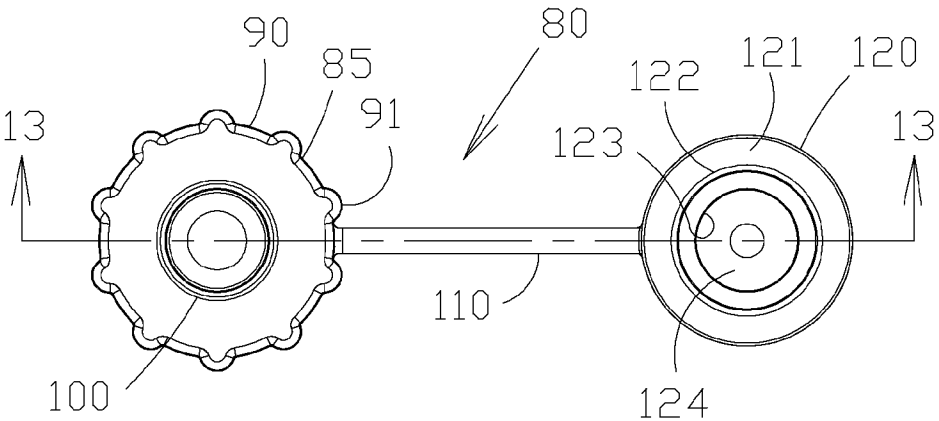
FIG. 10 is a top view of the embodiment shown in FIG. 9.
Figure 11:
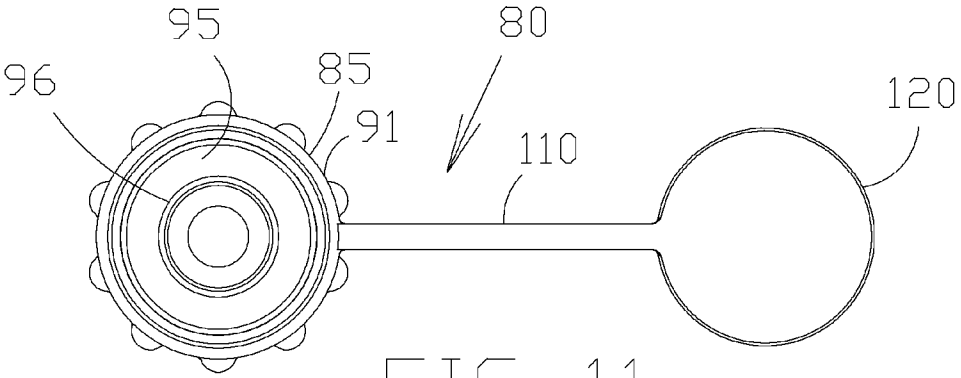
FIG. 11 is a bottom view of the embodiment shown in FIG. 9.
Figure 12:
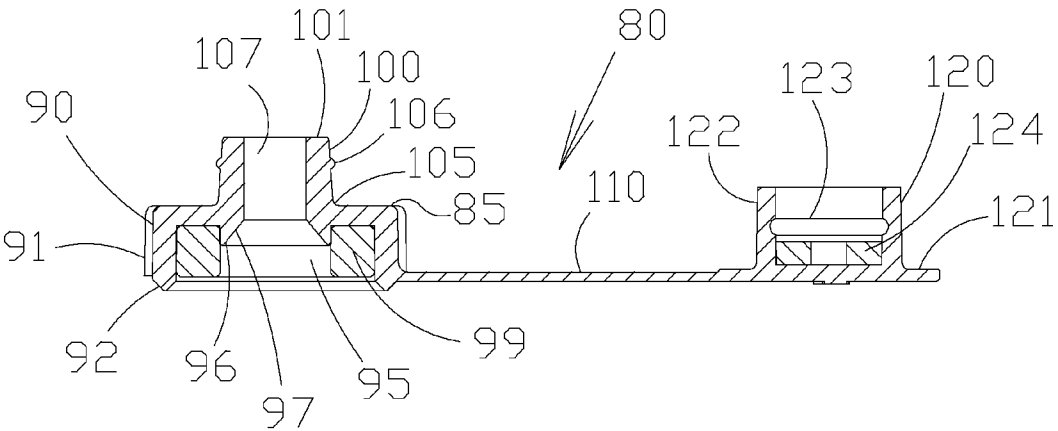
FIG. 12 is a cross-sectional view taken along line 12-12 in FIG. 10.

Turning now to FIG. 4, it is seen that the present invention can be used to evacuate air from a bag 5 having in inside surface 6 and an opposed outside surface 7. A valve assembly 10 is shown. The valve assembly is preferably made of plastic material, and the seals and gaskets are preferably made of a rubber material. However, it is appreciated that other materials may be used without departing from the broad aspects of the present invention. The valve assembly 10 has a longitudinal axis 11, and is comprised of an inside piece 30 and an outside piece 80. These two pieces 30 and 80 are described in detail below. Engagement of the inside piece 30 and outside piece 80 tears, breaks or pierces the bag and creates an evacuation path through the valve assembly for the air to be selectively evacuated.

Turning now to FIGS. 5-8, it is seen that a preferred embodiment of the first piece, inside piece 30, or inner piece, is provided. The inside piece 30 is comprised of a base 40 having a top surface 41 that lies in a plane. A chamber 42 is provided within the base. A plate 43 extends or fans partially around the perimeter of the base 40. A groove 44 or ridge is present adjacent the intersection of the fanning plate 43 and the base 40.

A spout 50 extends perpendicularly upwards preferably from the center of the top surface 41 of the base. The spout 50 of the inner piece 30 has a top 51 and a bottom 54. The top 51 is tapered with a taper 52 allowing for increased piercing ability. The bottom 55 is radiused with a radius 56. The outside of the spout 50 is preferably threaded with threads.

The spout has an internal cavity 60 or chamber. In this embodiment, the chamber is vertically oriented and is preferably generally cylindrically configured. However, other orientations and configurations could be provided without departing from the broad aspects of the present invention. The cavity has a central axis. The cavity has a top and a bottom. The top of the cavity is at the top of the spout. The bottom of the cavity is shown in the illustrated embodiment to be above the top surface 41 of the base 40. Preferably, a retainer 61 is within the cavity or chamber and is preferably integrally formed therewith. The retainer is preferably made of three protrusions that are radially aligned around the cavity wall.

The inside piece 30 further has a valve 70. The valve 70 has a neck 71 and a flange 72. A ball 73 is provided for opening and closing the valve 70. The valve is axially aligned with the central axis of the cavity 60. The ball 73 can be introduced to the cavity 60 by forcing the ball pass through the retainer 61. The operational pressure of the pump (described below) is insufficient to cause the ball to pass back through the retainer 61 when evacuating air from the bag 5. The ball 73 can be in a first position at the bottom of the cavity 60 wherein it acts as a check ball and forms a seal with the valve 70 to prevent air from passing through the valve. The ball 73 can also be in a second position at the middle or towards the top of the cavity wherein air is allowed to pass around the ball.

Turning now to FIGS. 9-12, it is seen that a preferred embodiment of a second piece, outer piece, or outside piece 80 is illustrated. The outer piece 80 generally has a housing 85 and a cap 120, connected and separated by a lanyard 110.

The housing 85 has a base 90 having a side wall 91. The sidewall 91 has a top and a bottom. The bottom terminates in an edge 92 that is preferably V-shaped. The sidewall is generally circular, and defines an internal void or cavity 95. A central lip 96 with an internal chamfer 97 is provided within and at the top of the void 95. The central lip is generally circular and is concentric with the sidewall 91.

A gasket 99 is provided and can be fixed within the void 95. The gasket is preferably ring shaped, and preferably made of a rubber or other high friction material. The gasket 99 can be adhesively or otherwise secured within the void 95.

A spout 100 extends vertically from the top of the housing 85, and is centrally aligned with the base 90. The spout 100 has a top 101 and a bottom 105, and inside and an outside. In this regard, the spout has a general cylindrical interior that defines an internal chamber 107. A rib 106 is exteriorly provided on the spout 100 intermediate the top 101 and bottom 105. The rib is preferably a continuous rim that radially extends all the way around the perimeter of the spout. The inside of spout 100 is preferably threaded with threads that are matable with the externally threaded spout 50.

Figure 15:
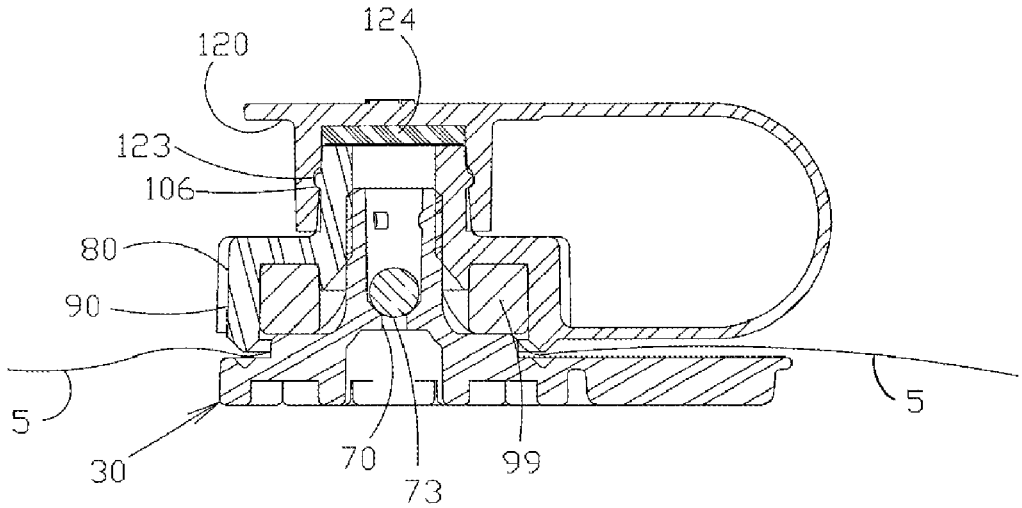
FIG. 15 is a cross-sectional view showing the cap in a sealing engagement with the rib on the outside piece of the valve assembly.

The cap 120 has a head 121 and a cylinder 122. The cylinder 122 has a top and a bottom, and an inside and an outside. A groove 123 is radially formed on the inside wall of the cylinder, and is shaped to mate with the rib 106 of the outside of the spout. A gasket 124 or seal is also provided. The seal contacts the top of the spout when the cap is properly positioned, in order to form an air tight seal, as seen if FIG. 15.

Turning now to FIGS. 1-4, it is seen how the inner piece 30 and outer piece 80 are selectably matable by twisting or rotating engagement. The inside of the spout of the outside piece 80 threadably engages the outside of the spout of the inside piece 30, whereby twisting in one direction causes the pieces to move closer together and twisting the opposite way causes the pieces to move apart. A seal is formed when the gasket 99 tightly presses upon the bag, which in turn is pressed upon the top surface 41 of the base of the inside piece. The gasket sticks, due to friction, to the outside 7 of the bag. The inside of the bag slides across the top surface 41 of the inside piece. The sliding of the bag relative the inside piece 30 prevents bunching of the bag.

Figure 1:
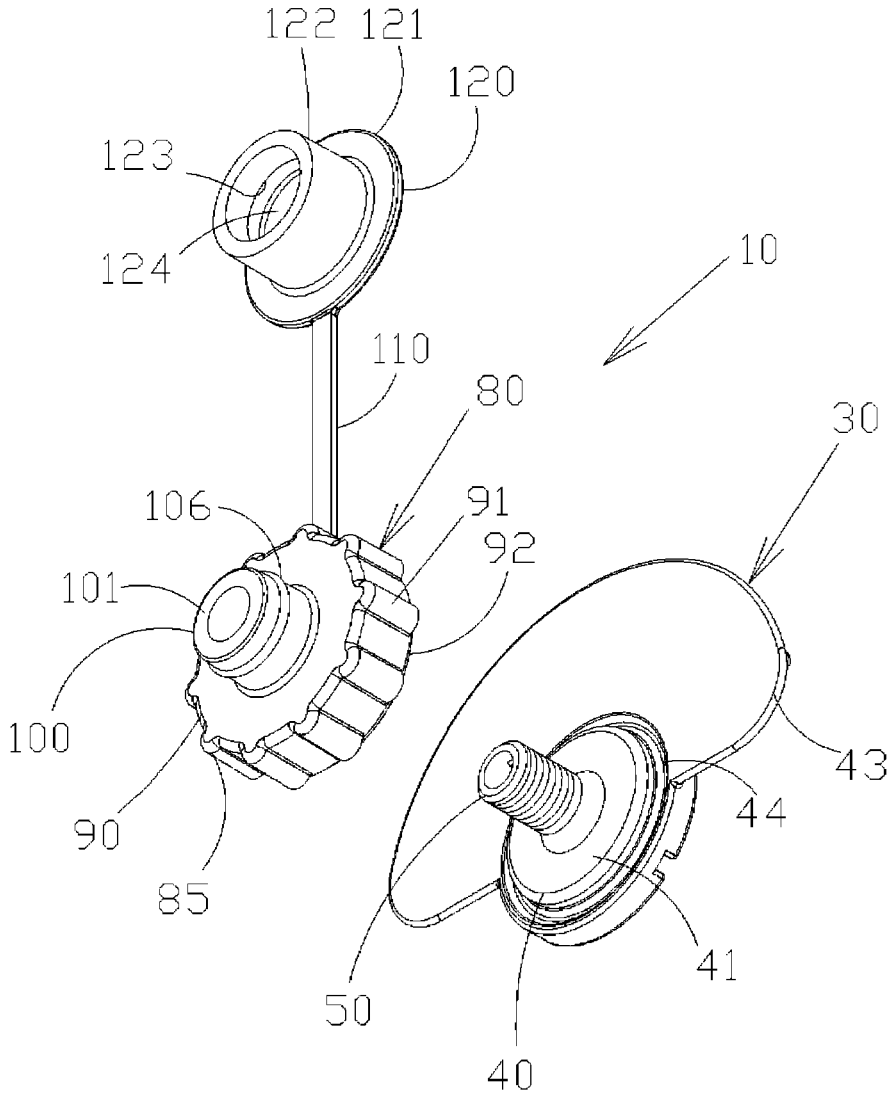
FIG. 1 is an exploded perspective view of an embodiment of a valve assembly of the present invention.
Figure 2:
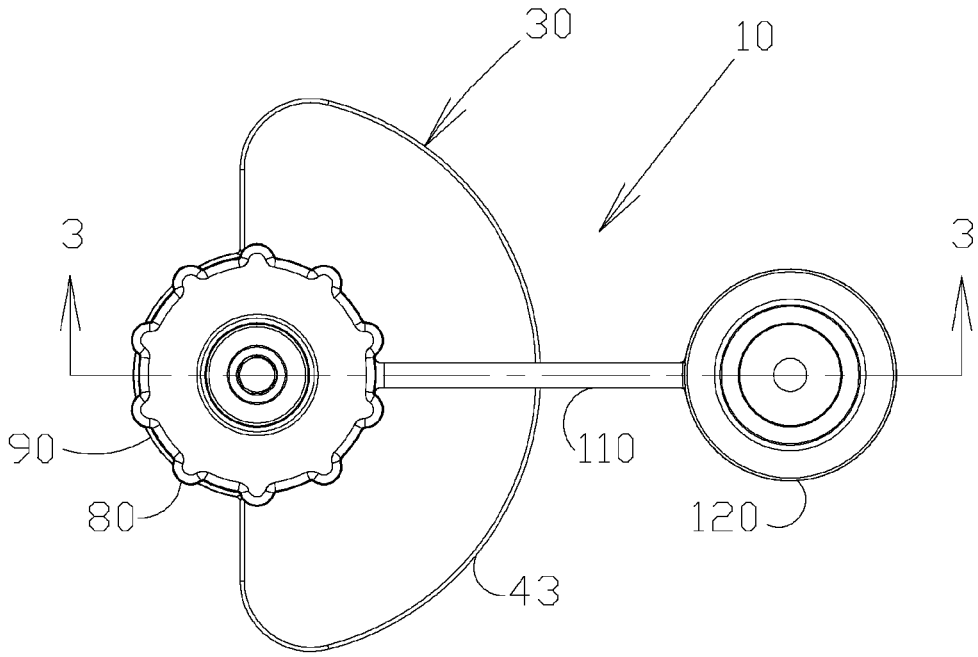
FIG. 2 is a top view of the embodiment of the valve assembly shown in FIG. 1.
Figure 3:
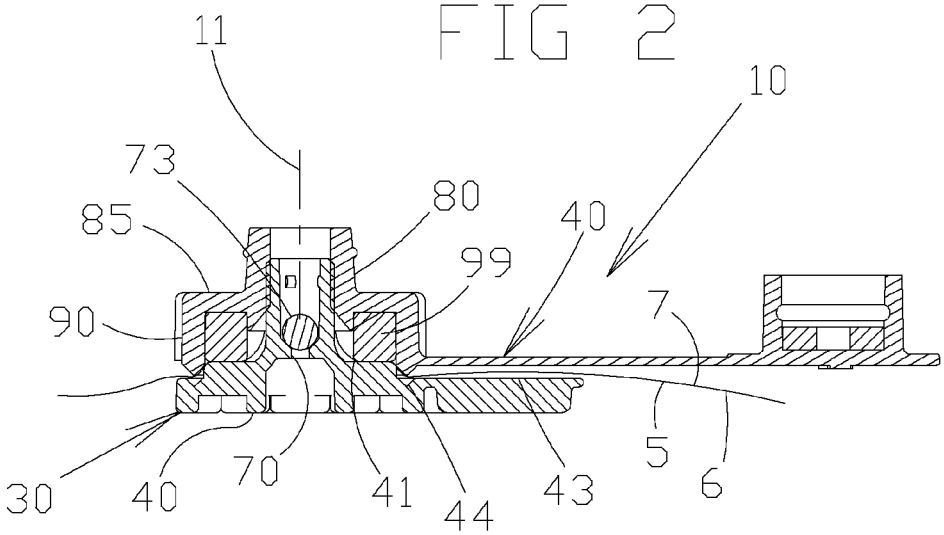
FIG. 3 is a cross-sectional view taken along line 3-3 in FIG. 2.

A predetermined amount of clearance is provided between edge 92 of sidewall 91 and ridge 44 of plate 43, as seen in FIG. 3, in order to accommodate bags of a variety of thicknesses.

The bag 5 is pierced when the pieces 30 and 80 are mated together, revealing an air evacuation path through the valve assembly 10.

Figure 13:
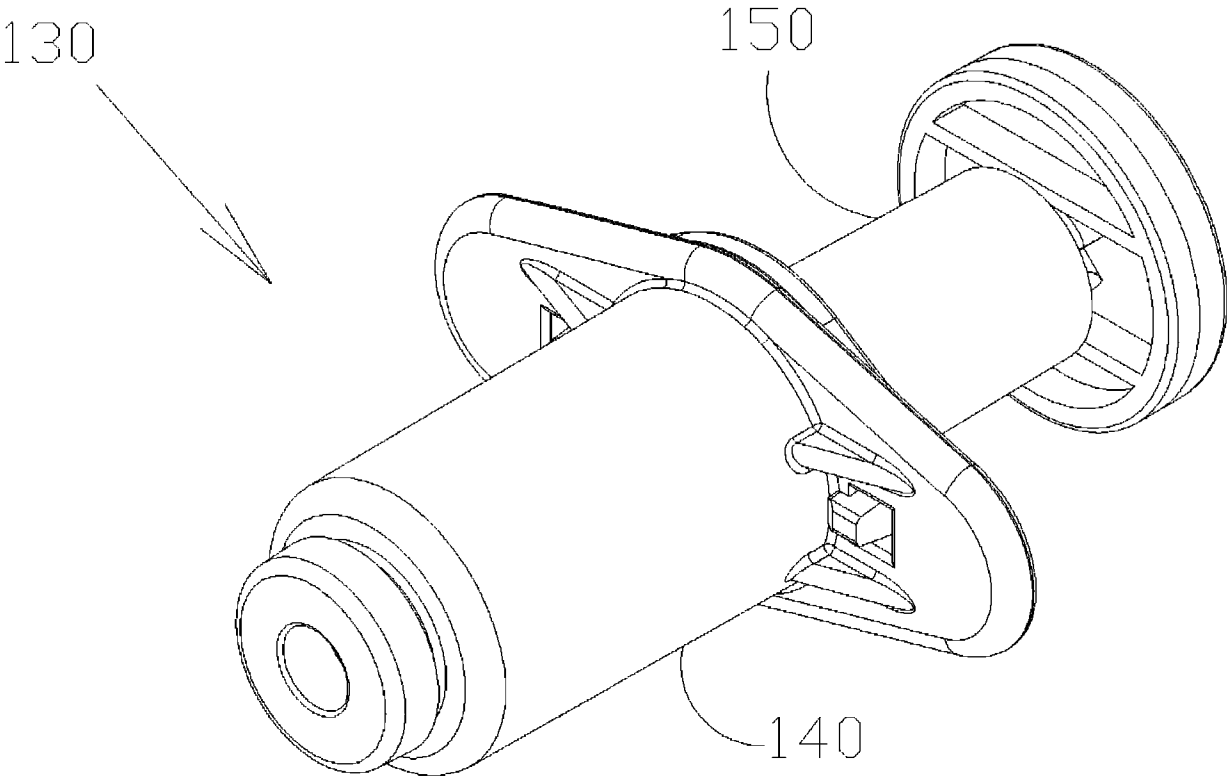
FIG. 13 is a perspective view of a preferred embodiment of a pump of the present invention.
Figure 14:
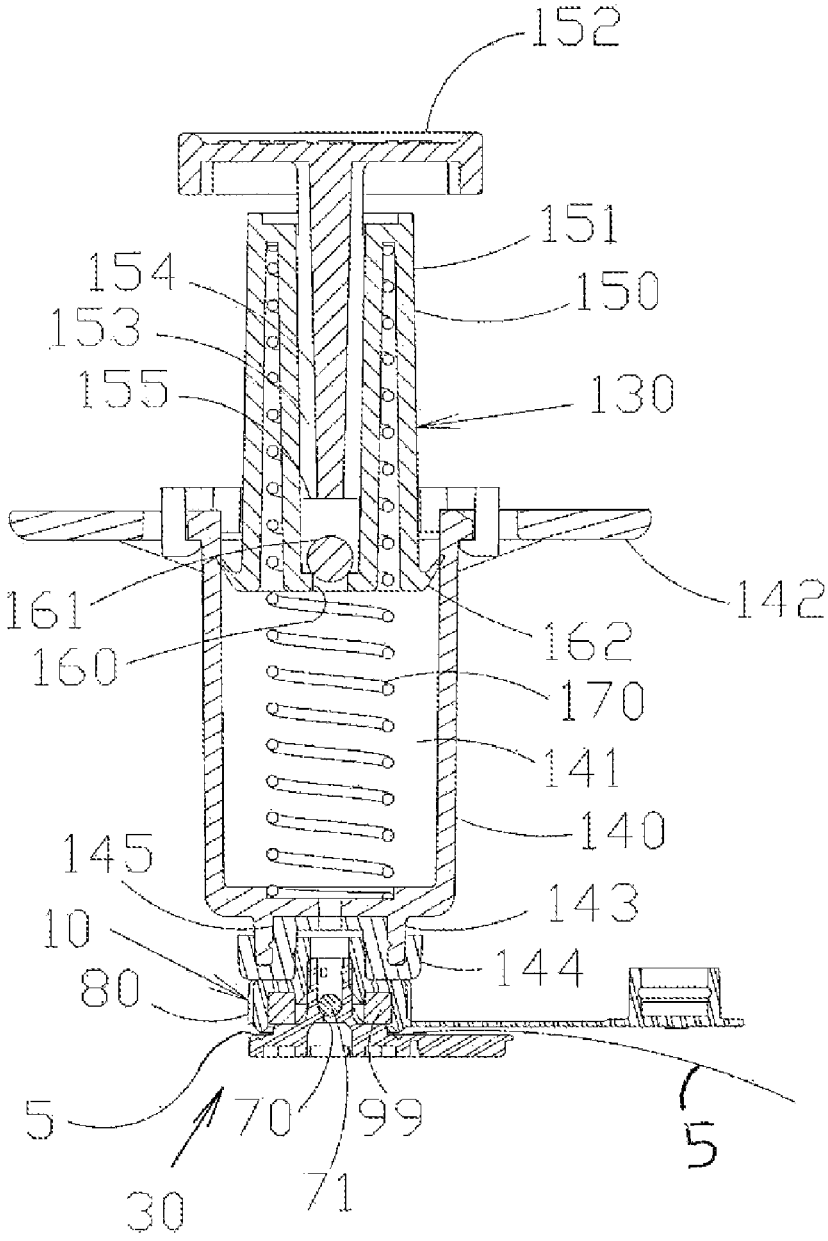
FIG. 14 is a cross-sectional view showing a preferred pump embodiment in sealing engagement with a preferred valve assembly.

Turning now to FIGS. 13 and 14, it is seen that a preferred embodiment of a pump 130 is illustrated. The pump 130 has a body 140 and an actuator 150. Each of these parts are described below.

The body 140 has an internal cavity 141 with a longitudinal axis. A handle 142 is provided, as is a base 143. A seal 144 is preferably fixed to the base 143. The seal 144 has an inside with an annular groove 145 formed therein.

The actuator has a body 151 and a handle 152. An internal cavity 153 is within the body 151. A member 154 depends within the cavity, and a flange 155 is on the end of the member 154 within the cavity 151. There is preferably an opening 160 at the bottom of the cavity 153, which can be covered by a ball 161. In this regard, the ball 161 can be in a first position covering the hole or opening 160, or a second position contacting the flange 155, wherein air can escape the internal cavity of the body 140. The ball is operational along a longitudinal axis. A seal 162 is provided on the actuator 150 to form a sealing sliding engagement between the actuator and the cavity 141 of the body 140.

A spring is provided to bias the handle 152 of the actuator away from the handle 142 of the body along an operational longitudinal axis.

In use, the seal 144 is positioned over the spout 100 of the outside piece, such that groove 145 receives rib 106. Air is evacuated by reciprocating operation of the pump 130. Forcing the handles 142 and 152 towards each other causes the check ball 73 within the inner piece 30 to remain covering the valve 70, and ball 161 is free to move towards flange 155 to allow the air within the cavity 141 of the pump to evacuate past the ball. When the pump handles are released, the spring 170 forces the handles to separate. The pressure differential keeps ball 161 in position to seal opening 160, and allows ball 73 to be removed from valve 70 and contact retainer 61. With the ball 73 against retainer 61, the air is free to evacuate from the inside of the bag in order to achieve an equilibrium pressure. Balls 73 and 161 operate along collinear longitudinal axises.

When the air has been fully or at least evacuated to an acceptable extent, the pump 130 can be removed from the valve assembly 10 and the cap 120 can be secured to maintain the sealed bag.

It is appreciated that while a manually manipulable pump is illustrated herein, that an electric and/or battery operated pump can alternatively be used without departing from the broad aspects of the present invention.

Thus it is apparent that there has been provided, in accordance with the invention, an air evacuation assembly and methods of using the same that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. An air evacuation assembly for removing air from a bag, said air evacuation assembly comprising:

an inside piece having an inside piece base for being received within a bag and an inside piece spout comprising a retainer fixed radially around a side wall, said side wall defining a substantially cylindrical inside piece spout inside surface and said retainer comprising a plurality of projections that are integral with said side wall and project inward from said substantially cylindrical inside piece spout inside surface;

an outside piece having an outside piece base and an outside piece top, said outside piece concentrically receiving said inside piece spout, and said outside piece top extending above said inside piece spout, said outside piece being sealed from said inside piece with a gasket between said outside piece base and said inside piece base and open to said inside piece through said inside piece spout;

a cavity within said inside piece spout and having a top, a middle and a bottom, said cavity containing a ball, said ball being retained within said cavity with said retainer, wherein said ball is movable to a first position at said bottom of said cavity wherein said cavity is sealed from said inside piece base, and a second position at said middle of said cavity wherein access through said cavity is allowed such that evacuated air passing from said air evacuation assembly exits said air evacuation assembly lastly through said outside piece top.

2. The air evacuation assembly of claim 1 wherein said inside piece spout has a top with a tapered thickness, whereby said spout is adapted to pierce a plastic bag.

3. The air evacuation assembly of claim 1 wherein:

said outside piece has an outside piece spout comprising an external rib continuously and radially around said outside piece spout, said external rib being selectably matable with a cap and a pump.

4. The air evacuation assembly of claim 1 wherein said inside piece and said outside piece are selectably matable to form a seal with a plastic bag.

5. The air evacuation assembly of claim 4 wherein, said gasket is fixed to one of said inside piece and said outside piece.

6. The air evacuation assembly of claim 5 wherein said gasket is fixed to said outside piece.

7. The air evacuation assembly of claim 6 wherein:

said inside piece and said outside piece are mated in threaded engagement;

twisting of said inside piece relative said outside piece in a first direction causes said inside piece base to move towards said outside piece base, and twisting of said inside piece relative said outside piece in the opposite direction causes said inside piece base to move away from said outside piece base; and said gasket frictionally engages the plastic bag and said plastic bag slides against said inside piece base to prevent bunching of the bag.

8. The air evacuation assembly of claim 1 further comprising a pump, said pump comprising a pump check ball, wherein:

said pump check ball is operational along a pump check ball longitudinal axis; and that is collinear with an axis of operation of said ball contained within said cavity.

* * * * *